US006382436B1

(12) United States Patent
Wang

(10) Patent No.: US 6,382,436 B1
(45) Date of Patent: May 7, 2002

(54) DISPLAY RACK

(76) Inventor: Wen-Tsan Wang, P.O. Box 82-144, Taipei (TW)

( * ) Notice: Subject to any disclaimer, the term of this patent is extended or adjusted under 35 U.S.C. 154(b) by 0 days.

(21) Appl. No.: 09/671,181

(22) Filed: Sep. 28, 2000

(51) Int. Cl.[7] ..... A47B 57/00

(52) U.S. Cl. ..... 211/207; 211/187; 248/243; 248/297.21

(58) Field of Search ..... 211/207, 190, 211/41.17, 187, 89.01, 119.003; 248/572, 162.2, 162.1, 123.1, 297.21, 243; 108/136

(56) References Cited

U.S. PATENT DOCUMENTS 1,185,793 A * 6/1916 Hanson ..... 211/59.3 X
2,251,874 A * 8/1941 Gibbs ..... 211/59.3 X
2,471,998 A * 5/1949 Berggren ..... 248/572
2,560,928 A * 7/1951 Bockius ..... 108/136
2,802,575 A * 8/1957 Harrison ..... 108/136 X
2,901,202 A * 8/1959 Stava et al. ..... 248/572 X
3,511,548 A * 5/1970 McIlhone ..... 108/136 X
3,575,368 A * 4/1971 Thomas ..... 248/162.1 X
4,605,189 A * 8/1986 Bruneau ..... 248/162.1
4,685,648 A * 8/1987 Dobner et al. ..... 248/572
4,760,622 A * 8/1988 Rohrman ..... 248/572 X
5,355,835 A * 10/1994 Freed ..... 248/162.1 X
5,941,399 A * 8/1999 Wang ..... 211/187

* cited by examiner

*Primary Examiner*—Daniel P. Stodola
*Assistant Examiner*—Khoa Tran
(74) *Attorney, Agent, or Firm*—A & J

(57) ABSTRACT

A display rack includes an upright support, a sliding block moved along a longitudinal sliding groove at the upright support, two clamping blocks coupled to the sliding block by a screw rod, and a holder frame fixedly fastened to the screw rod and turned between the operative position for holding a board where the clamping blocks are clamped on the sliding block to fix the sliding block to the upright support at the desired elevation and the non-operative position where the sliding block is released from the clamping blocks and allowed to be moved along the longitudinal sliding groove to the desired elevation, wherein a pulley is suspended inside the upright support and aimed at a transverse through hole within the longitudinal sliding groove at the upright support, a spring member is fixedly mounted inside the upright support at the bottom, and a steel cable is inserted through the transverse through hole on the upright support and passed through the pulley and connected between the spring member and the sliding block to prevent the sliding block from falling down suddenly when the sliding block is release from the clamping blocks.

2 Claims, 3 Drawing Sheets

DISPLAY RACK

BACKGROUND OF THE INVENTION

The present invention relates to a display rack used in holding a carrying board for holding articles for display, and more particularly to such a display rack which enables the carrying board to be smoothly adjusted to the desired elevation.

There is known a display rack comprised of an upright support, the upright support having a plurality of longitudinal sliding grooves equiangularly spaced around the periphery, a sliding block moved along one longitudinal sliding groove of the upright support, the sliding block having a vertical locating groove at a front side thereof the two through holes aligned at two opposite sides of the vertical locating groove, a screw rod inserted through the through holes on the sliding block, the screw rod having a left-handed thread at one end and a right-handed thread at an opposite end, two clamping blocks respectively mounted on the screw rod at two opposite ends, the clamping blocks each having a coupling block inserted into one longitudinal sliding groove at the upright support and a clamping base adapted to clamp the sliding block, the clamping base of one of the clamping blocks having a left-handed screw hole threaded onto the left-handed thread of the screw rod, the clamping base of the other of the clamping blocks having a right-handed screw hole threaded on the right-handed thread of said screw rod, and a holder frame fixedly mounted on the screw rod on the middle within the locating groove at the sliding block, and adapted to hold a board for carrying things, the holder frame being turned between a first position where the screw rod is rotated in one direction to move the clamping blocks apart from the sliding block, enabling the sliding block to be moved along the corresponding longitudinal sliding groove to the desired elevation, and a second position where the screw rod is rotated in the reversed direction to move the clamping blocks towards each other, causing the clamping blocks to clamp on the sliding block and a part of the upright support, enabling the sliding block to be firmly retained to the upright support at the desired elevation. This structure of display rack is functional, however when the holder frame is turned to the non-operative position to release the sliding block, the board and the load on the board may fall with the sliding block to the ground, causing the displayed articles to be damaged. Therefore, when the user turns the holder frame to adjust the elevation of the sliding block with one hand, the user must hold the board with the other hand.

SUMMARY OF THE INVENTION

The present invention eliminates the aforesaid problem. According to the present invention, a pulley is suspended inside the upright support and aimed at a transverse through hole within the longitudinal sliding groove at the upright support, a spring member is fixedly mounted inside the upright support at the bottom, and a steel cable is inserted through the transverse through hole on the upright support and passed through the pulley and connected between the spring member and the sliding block to prevent the sliding block from falling down suddenly when the sliding block is release from the clamping blocks.

DETAILED DESCRIPTION OF THE PREFERRED EMBODIMENT

Figure 1:
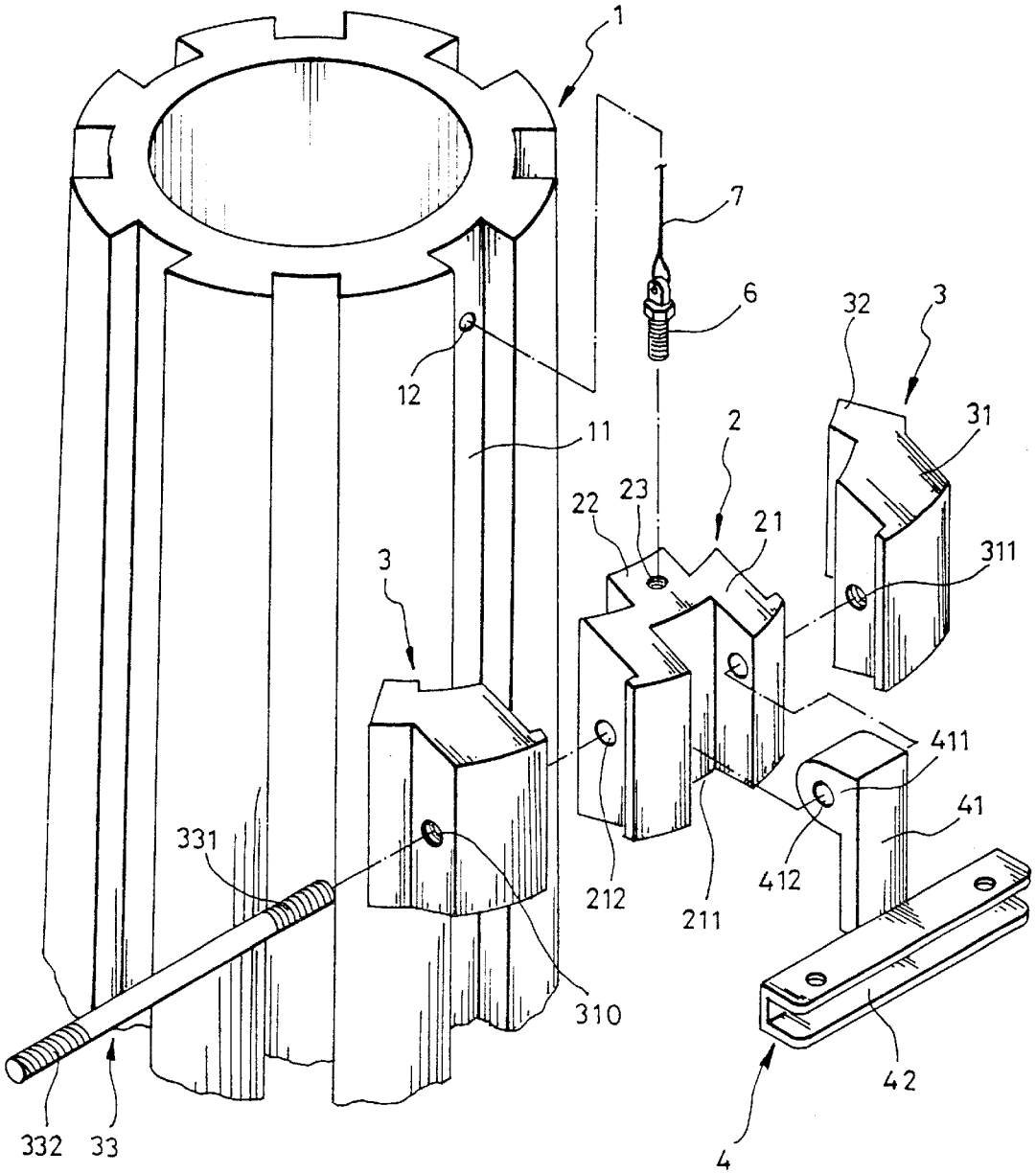
FIG. 1 is an exploded view of the present invention.
Figure 2:
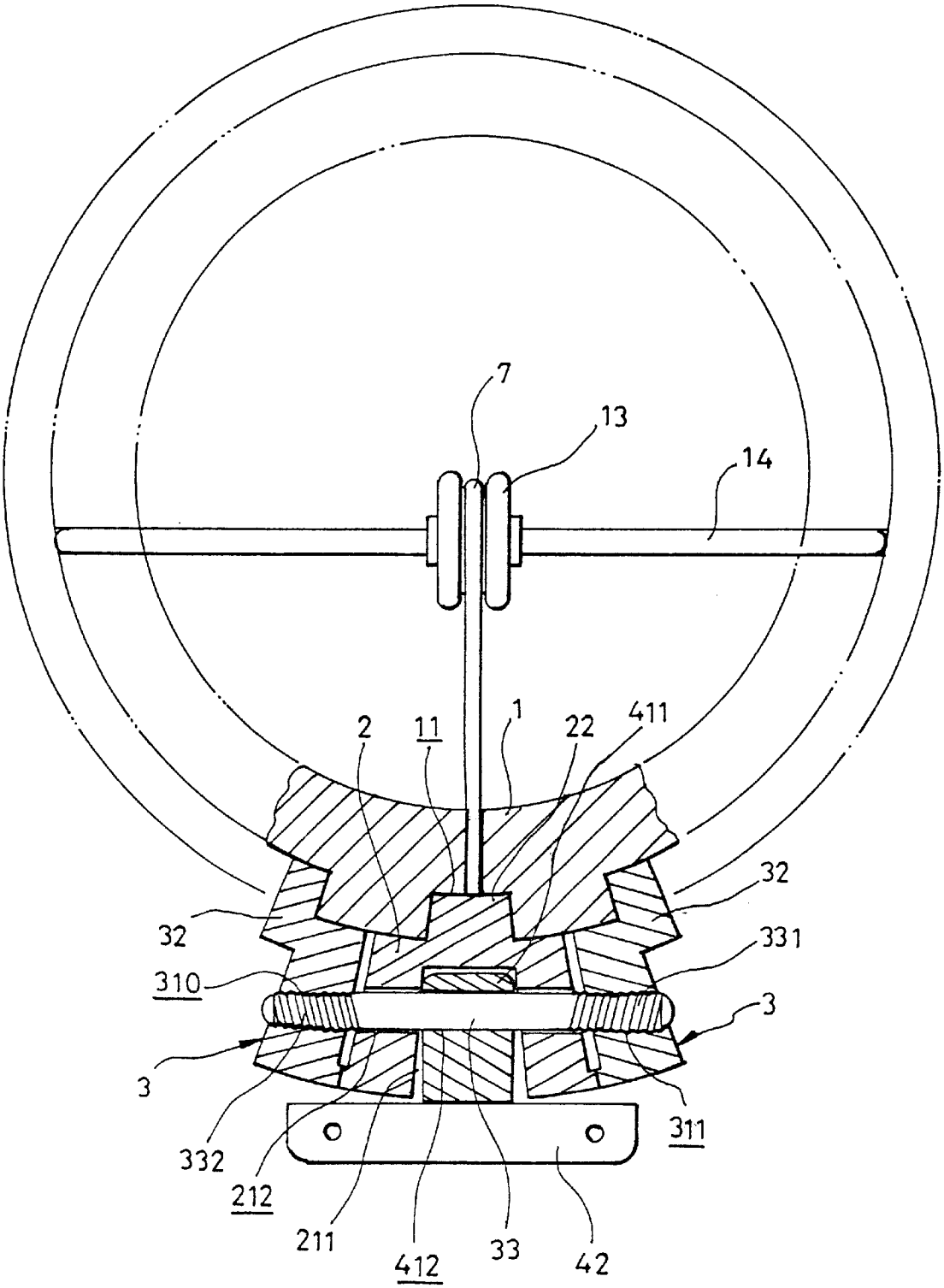
FIG. 2 is a top plan view of the present invention with a part in section.

Referring to FIGS. 1 and 2, the upright support, referenced by 1, is a tubular member having a plurality of longitudinal sliding grooves 11 equiangularly spaced around the periphery and extended through top and bottom ends thereof, and a transverse through hole 12 at one longitudinal sliding groove 11 near the top end. A spring member 15 is fixedly mounted inside the upright support 1 at the bottom. An axle 14 is transversely mounted inside the upright support 1 at an elevation approximately equal to the transverse through hole 12. A pulley 13 is revolvably mounted on the axle 14 on the middle, and aimed at the transverse through hole 12. A steel cable 7 is inserted through the transverse through hole 12, having an inner end wound round the pulley 13 inside the upright support 1 and then connected to the spring member 15 and an outer end disposed outside the upright support and fixedly connected to a connector 6. The connector 6 is a screw member 6 threaded into a top screw hole 23 on a sliding block 2. The sliding block 2 comprises a base 21, and a coupling portion 22 raised form a back side wall of the base 21. The coupling portion 22 is inserted into the longitudinal sliding groove 11 on which the transverse through hole 12 is allocated, and moved with the base 21 up and down along it. The base 21 of the sliding block 2 has a longitudinal location groove 211 at the front side wall thereof on the middle, and two transverse through holes 212 aligned at two opposite sides of the longitudinal locating groove 211. A holder frame 4 is coupled to the sliding block 2 by a screw rod 33. The holder frame 4 comprises a holder body 42 adapted to hold a board 5, an arm 41 perpendicularly extended from the holder body 42 on the middle, and a mounting block 411 integral with one end of the arm 41 remote from the holder body 42. The mounting block 411 is inserted into the longitudinal locating groove 211 and pivotably coupled to the base 12 of the sliding block 2 by the screw rod 33. The mounting block 411 has a transverse through hole 412 aligned between the transverse through holes 212 on the sliding block 2. The screw rod 33 is inserted through the transverse through holes 212 on the sliding block 2 and the transverse through hole 412 on the mounting block 411 of the holder frame 4, having a left-handed thread 331 at one end and a right-handed thread 332 at an opposite end. After installation o the screw rod 33 in the transverse through holes 212, 412, the mounting block 411 is fixedly secured to the screw rod 33 on the middle by welding. Further, two clamping blocks 3 are respectively fastened to the two opposite ends of the screw rod 33 and coupled to the longitudinal sliding grooves 11 at the upright support 1 at two opposite sides of the sliding block 2 to fix the sliding block 2 at the desired elevation. The clamping blocks 3 each comprise a clamping base 31 and a coupling block 32 extended from the clamping base 31. The thickness of the coupling block 32 is smaller than the width of the longitudinal sliding grooves 11, therefore the coupling block 32 can be moved transversely when it is inserted in one longitudinal sliding groove 11 at the upright support 1. The clamping base 31 if one clamping block 3 has a left-handed screw hole 311 while the other having a right-handed screw hole 310. The right-handed screw hole 310 and the left handed-screw hole 311 of the clamping blocks 3 are respectively threaded into the right-handed thread 332 and left-handed thread 333 of the screw rod 33.

Figure 3:
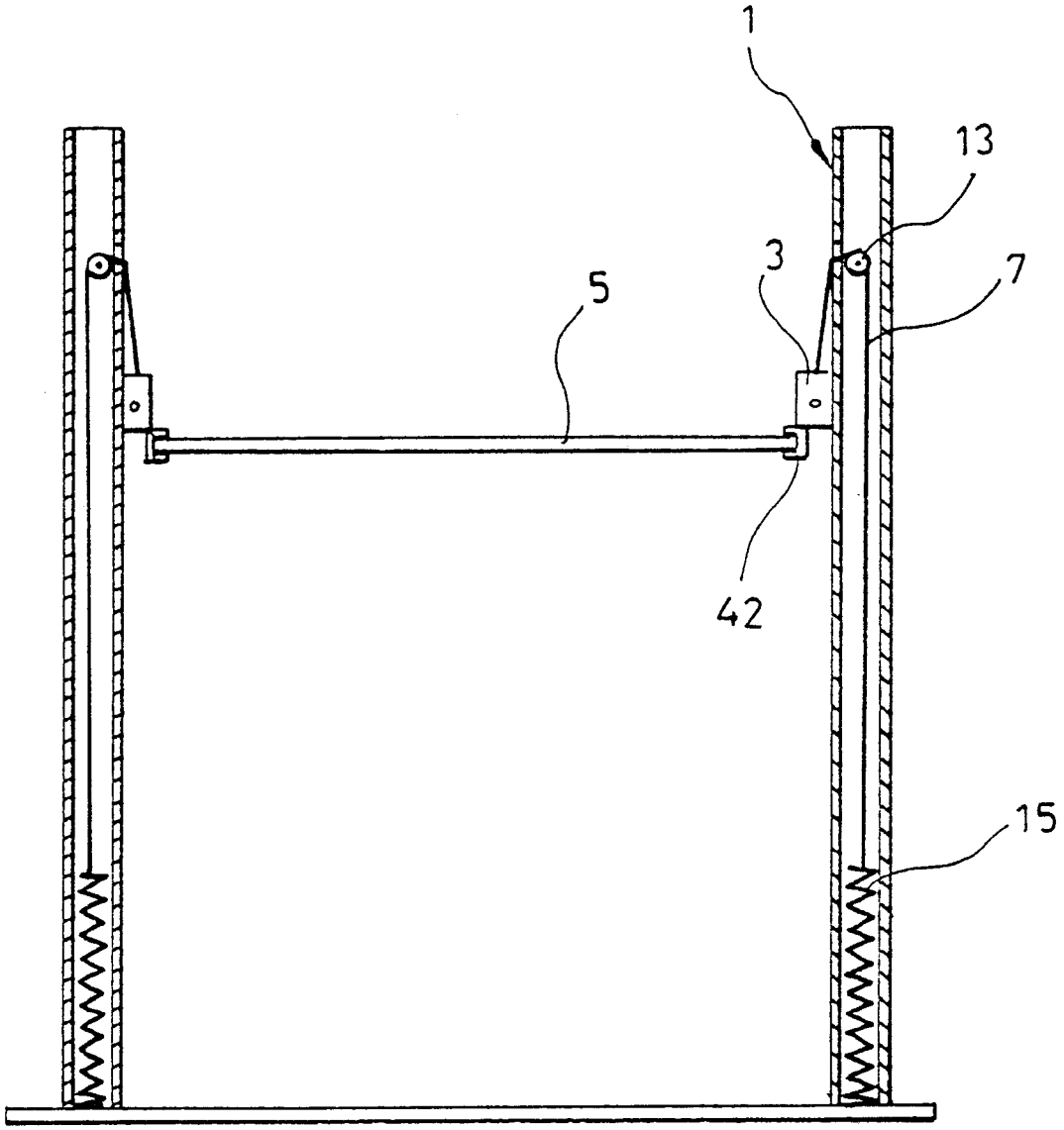
FIG. 3 is an applied view of the present invention.

Referring to FIG. 3 and FIG. 2 again, after installation, the holder frame 4 can be turned downwards and upwards within 180° , between the operative position and the non-operative position. When the holder frame 4 is turned upwards to the non-operative position, the screw rod 33 is rotated through 180° angle, causing the clamping blocks 3 to be moved apart from the sliding block 2. When the clamping blocks 3 are disengaged from the sliding block 2, the sliding block 2 can then be moved along the respective longitudinal sliding groove 11 to the desired elevation. After an adjustment, the holder frame 4 is turned downwards to the operative position, causing the clamping blocks 3 to be moved inwards along the screw rod 33 and firmly clamped on the base 21 of the sliding block 2 and respective vertical peripheral side wall of the respective longitudinal sliding grooves 11, and therefore the sliding block 2 is fixed at the desired elevation to hold a board 5 for carrying things. Because the steel cable 7 is connected to the spring member 15 inside the upright support 1, the weight of the load carrying on the board 5 does not cause the sliding block 2 to fall to the ground suddenly when the sliding block 2 is disengaged from the clamping blocks 3.

What the invention claimed is:

1. A display rack comprising an upright support, said upright support having a plurality of longitudinal sliding grooves equiangularly spaced around the periphery, a sliding block moved along one longitudinal sliding groove of said upright support, said sliding block having a vertical locating groove at a front side thereof and two through holes aligned at two opposite sides of said vertical locating groove, a screw rod inserted through the through holes on said sliding block, said screw rod having a left-handed thread at one end and a right-handed thread at an opposite end, two clamping blocks respectively mounted on said screw rod at two opposite ends, said clamping blocks each having a coupling block inserted into one longitudinal sliding groove at said upright support and a clamping base adapted to clamp said sliding block, the clamping base of one of said clamping blocks having a left-handed screw hole threaded onto the left-handed thread of said screw rod, the clamping base of the other of said clamping blocks having a right-handed screw hole threaded onto the right-handed thread of said screw rod, and a holder frame fixedly mounted on said screw rod on the middle within the locating groove at said sliding block and adapted to hold a board for carrying things, said holder frame being turned between a first position where said screw rod is rotated in one direction to move said clamping blocks apart from said sliding block, enabling said sliding block to be moved along the corresponding longitudinal sliding groove to the desired elevation, and a second position where said screw rod is rotated in the reversed direction to move said clamping blocks towards each other, causing said clamping blocks to clamp on said sliding block and a part of said upright support, enabling said sliding block to be firmly retained to said upright support at the desired elevation, wherein said upright support is a tubular member having a transverse through hole near a top end thereof within one longitudinal sliding groove in which said sliding block is moved, a pulley is suspended inside said upright support and directed to the transverse through hole on said upright support, a spring member is fixedly mounted inside said upright support at a bottom end of said upright support, and a steel cable is inserted through the transverse through hole on said upright support and passed around said pulley and connected between said spring member and said sliding block to prevent said sliding block from falling down when said sliding block is released from said clamping blocks.

2. The display rack of claim 1 wherein said sliding block comprises a top screw hole, and a connector fixedly fastened to said top screw hole and connected to one end of said steel cable outside said upright support.

* * * * *